US012553670B2

(12) United States Patent
Walusiak et al.

(10) Patent No.: US 12,553,670 B2
(45) Date of Patent: Feb. 17, 2026

(54) COOLING ASSEMBLY

(71) Applicant: Valeo Autosystemy Sp. z o.o., Skawina (PL)

(72) Inventors: Pawel Walusiak, Skawina (PL); Mateusz Moryc, Skawina (PL); Tomasz Barylka, Skawina (PL); Dawid Szostek, Skawina (PL)

(73) Assignee: Valeo Autosystemy Sp. z o.o., Skawina (PL)

( * ) Notice: Subject to any disclaimer, the term of this patent is extended or adjusted under 35 U.S.C. 154(b) by 218 days.

(21) Appl. No.: 18/278,497

(22) PCT Filed: Jan. 19, 2022

(86) PCT No.: PCT/EP2022/051122
§ 371 (c)(1),
(2) Date: Aug. 23, 2023

(87) PCT Pub. No.: WO2022/179771
PCT Pub. Date: Sep. 1, 2022

(65) Prior Publication Data

US 2024/0053104 A1 Feb. 15, 2024

(30) Foreign Application Priority Data

Feb. 24, 2021 (EP) ..... 21159041

(51) Int. Cl.
*F28F 9/00* (2006.01)
*F28D 1/04* (2006.01)
*F28D 21/00* (2006.01)

(52) U.S. Cl.
CPC ..... *F28D 1/0435* (2013.01); *F28F 9/002* (2013.01); *F28D 2021/008* (2013.01); *F28F 2275/085* (2013.01)

(58) Field of Classification Search
CPC ..... F28F 9/002; F28F 2275/085; F28D 2021/008; F28D 1/0435
See application file for complete search history.

(56) References Cited

U.S. PATENT DOCUMENTS 6,158,500 A * 12/2000 Heine ..... F28F 9/002 165/140
6,772,982 B2 * 8/2004 Nakagawa ..... B60K 11/04 248/233

(Continued)

FOREIGN PATENT DOCUMENTS

EP 2642235 A1 * 9/2013 ..... F28D 1/0435
FR 2779221 A1 12/1999

(Continued)

OTHER PUBLICATIONS

International Search Report and Written Opinion in corresponding International Application No. PCT/EP2022/051122, dated Feb. 28, 2022 (11 pages).

*Primary Examiner* — Devon Lane
(74) *Attorney, Agent, or Firm* — Osha Bergman Watanabe & Burton LLP

(57) ABSTRACT

A cooling assembly configured to provide a heat exchange between the fluids comprising: at least one first heat exchanger comprising a pair of first manifolds comprising an axis of elongation of the first manifolds, and a plurality of first tubes stacked between the first manifolds, each first tube comprising an axis of elongation of the first tubes which is substantially perpendicular to axis of elongation of the first manifolds. The axes form the general plane of the first heat exchanger, at least one second heat exchanger comprising a pair of second manifolds comprising an axis of elongation of the second manifolds, and a plurality of second tubes stacked between the second manifolds, each second tube comprising an axis of elongation of the second tubes (Continued)

which is substantially perpendicular to axis of elongation of the second manifolds.

15 Claims, 8 Drawing Sheets

(56) References Cited

U.S. PATENT DOCUMENTS

| | | | | |
|---|---|---|---|---|
| 2007/0125525 | A1* | 6/2007 | Heine | F28F 9/002 123/41.56 |
| 2009/0178781 | A1* | 7/2009 | Park | F28F 9/002 165/149 |
| 2016/0001629 | A1* | 1/2016 | Rohr | B60K 11/04 165/76 |
| 2016/0356557 | A1* | 12/2016 | Giordano | B60K 11/04 |

FOREIGN PATENT DOCUMENTS

| | | | | |
|---|---|---|---|---|
| FR | 2979424 | A1 * | 3/2013 | F28D 1/0435 |
| JP | 2002139294 | A * | 5/2002 | F28D 1/0435 |

* cited by examiner

COOLING ASSEMBLY

FIELD OF THE INVENTION

The invention relates to a cooling assembly. In particular, the invention relates to the cooling assembly for a motor vehicle.

BACKGROUND OF THE INVENTION

Heat exchangers in motor vehicles are usually responsible for thermal management of the powertrain, the air conditioning system, the power steering system, and other. This includes, for example, internal combustion vehicles, hybrid vehicles and electric vehicles, wherein the proper management of the heat can reflect on emissions, fuel or energy consumption, maximal driving range, etc.

The heat exchangers these days are usually made of a metal components, such as aluminum assembled with a synthetic components, such as plastic. The sub-components responsible for heat exchange, such as the heat exchanger core comprising tubes assembled with the headers are usually made of metal component, whereas the sub-components responsible for delivering or collecting the media, such as tanks, are usually made synthetic material.

The evolution of motor vehicles includes improving the existing solutions by supporting them with electronics, as well as implementing new solutions. Therefore, there is an increased interest in reducing the size and weight of particular sub-components of the motor vehicle. On the other hand, reducing the size of, for example, heat exchangers will directly impact the thermal performance of the whole motor vehicle.

The size of the heat exchanger may be reduced by implementing specific architectures that provide the same or better efficiency while using the smaller amount of space. As the result, the packaging in the motor vehicle may increase.

Nowadays, the reduction of weight of sub-components is one of the main factors which determines not only the final price of the vehicle, but also its total carbon footprint. The less material is used for production of, for example, synthetic sub-components, the less waste is produced both during vehicle's production and after vehicle's service life, whenever the sub-components of the vehicle are scrapped or re-cycled. Moreover, the less the vehicle weights, the smaller fuel consumption may be achieved. Consequently, the vehicle emits less pollution during its service life. Further, the light-weight cooling assemblies are good incentive for car manufacturers, because it may allow them to meet strict emissions requirements.

The car manufacturers constantly seek for more economical solutions which would fulfill the efficiency and weight requirements. Therefore, the research centers need to find a compromise between several factors in order to provide their customers with an ultimate, inexpensive, efficient and light-weight cooling assembly.

The existing solutions focus mainly on reducing the size of particular sub-components or decreasing the distance between the heat exchangers. Usually the headers of at least two heat exchangers are assembled in the close vicinity in order to reduce the total dimensions of created cooling module. The known cooling modules focus mainly on assembling process of two or three heat exchangers, wherein the particular sub-components provide means of attaching one heat exchanger to the other. However, none of the known documents suggests further improvements regarding cost and weight reduction.

Concerning the problems featured by the state of the art, it is desirable to create a cooling module comprising several heat exchangers, which would be of good feasibility and which would significantly reduce the production cost.

SUMMARY OF THE INVENTION

The object of the invention is, among others, a cooling assembly configured to provide a heat exchange between the fluids comprising: at least one first heat exchanger comprising a pair of first manifolds comprising an axis of elongation of the first manifolds, and a plurality of first tubes stacked between the first manifolds, each first tube comprising an axis of elongation of the first tubes which is substantially perpendicular to axis of elongation of the first manifolds, wherein the axes form the general plane of the first heat exchanger, at least one second heat exchanger comprising a pair of second manifolds comprising an axis of elongation of the second manifolds, and a plurality of second tubes stacked between the second manifolds, each second tube comprising an axis of elongation of the second tubes which is substantially perpendicular to axis of elongation of the second manifolds, wherein the axes form the general plane of the second heat exchanger, at least one third heat exchanger comprising a pair of third manifolds comprising an axis of elongation of the third manifolds, and a plurality of third tubes stacked between the third manifolds, each third tube comprising an axis of elongation of the third tubes which is substantially perpendicular to axis of elongation of the third manifolds, wherein the axes form the general plane of the third heat exchanger, characterised in that the second heat exchanger is adapted to be fixed to the first heat exchanger at least by pivoting thereof around an axis of elongation of the second manifold until the general plane of the second heat exchanger is parallel to the general plane of the first heat exchanger, and in that the third heat exchanger is adapted to be fixed to the first heat exchanger along the axis perpendicular to the general planes of the heat exchangers by at least pushing the third heat exchanger towards the first heat exchanger so that the planes remain parallel with respect to each other during and after fixing one heat exchanger to the other.

Advantageously, at least one of the first manifolds comprises at least one essentially U-shaped portion configured to receive one of the second manifolds so that it enables rotation the manifold around its axis of elongation while in contact therewith.

Advantageously, at least one of the first manifolds comprises at least one first clip configured to immobilize the second heat exchanger at least in a direction transverse to axis of elongation of the first manifolds.

Advantageously, the second manifold comprises at least one second connection block fluidly connected therewith, wherein the second connection block is configured to engage with at least one of the first clips.

Advantageously, at least one of the first manifolds comprises a support configured to provide a parallel alignment of the axis of elongation of the second tubes with respect to axis of elongation of the first tubes.

Advantageously, at least one of the first manifolds comprises at least one tensioner configured to engage with at least one of the second manifolds so that the manifold is pushed towards the support in parallel direction with respect to axis of elongation of the second manifold.

Advantageously, the support protrudes from the U-shaped portion so that it enables rotation the manifold around its axis of elongation while in contact therewith.

Advantageously, the tensioner protrudes from the U-shaped portion so that the free end of the tensioner is oriented in the same direction as at least one free end of the U-shaped portion.

Advantageously, the U-shaped portion comprises at least one rib located between the inner face of the U-shaped portion and the second manifold, wherein the rib is configured to secure the second heat exchanger in a perpendicular direction with respect to the general plane thereof, after pivoting the second heat exchanger around an axis of elongation of the second manifold.

Advantageously, the second heat exchanger comprises a bottle fluidly connected to at least one second manifold, the bottle being coplanar with the general plane of the second heat exchanger, wherein the U-shaped portion is configured to receive the bottle so that it enables rotation of the bottle around its axis of elongation while in contact therewith.

Advantageously, the second heat exchanger is secured to the first heat exchanger by shifting one in opposite direction with respect to the other along their parallel general planes.

Advantageously, the first manifold comprises a first bottle clip, and a first bottle support, the bottle comprises a first bottle protrusion and a second bottle protrusion, wherein the first bottle support is configured to support the second bottle protrusion and the first bottle clip is configured to be engaged with the first bottle protrusion, so that the second heat exchanger is secured to the first heat exchanger.

Advantageously, the U-shaped portion comprises at least one primary bottle tensioner configured to mitigate a gap between the bottle and the U-shaped portion.

Advantageously, at least one of the first manifolds comprises at least one L-shaped support protruding from the at least one first manifold, wherein the free end of the L-shaped portion is pointing a direction parallel with respect to the main axis of the first manifold, and the first clip pointing a direction substantially opposite to the direction of the free end of the L-shaped portion.

Advantageously, the second heat exchanger is fixed the first heat exchanger by pivoting thereof around an axis of elongation of the second manifold until the general plane of the second heat exchanger is parallel to the general plane of the first heat exchanger, and by moving the second heat exchanger along its general plane towards the L-shaped support and the first clip until the second heat exchanger is immobilized.

Advantageously, each third manifold comprises at least one flat protrusion extending outwardly and substantially parallel with respect to the general plane.

Advantageously, each first manifold comprises at least one L-shaped support protruding therefrom, wherein the free end of the L-shaped support is pointing in a direction parallel with respect to the main axis of the first manifolds.

Advantageously, at least one L-shaped support is protruding from the U-shaped portion of the first manifold.

Advantageously, the L-shaped support comprises a third clip configured to engage with respective flat protrusion.

Advantageously, the flat protrusions engage with respective L-shaped supports so that the third heat exchanger is fixed to the first heat exchanger.

Advantageously, the cooling assembly comprises a fourth heat exchanger comprising a pair of fourth manifolds comprising an axis of elongation of the fourth manifolds, and a plurality of fourth tubes stacked between the fourth manifolds, the stack of fourth tubes comprising two terminal tubes located on opposite sides of the stack, each fourth tube comprising an axis of elongation of the fourth tubes which is substantially perpendicular to axis of elongation of the fourth manifold, wherein the axes form the general plane of the fourth heat exchanger and wherein the fourth heat exchanger is adapted to be fixed at least to the first heat exchanger at least by pivoting thereof around an axis of elongation of the terminal tube until the general plane of the fourth heat exchanger is parallel to the general plane of the first heat exchanger.

Advantageously, the first manifolds comprise a pair of C-shaped hooks adapted to provide a hinge-like connection with the fourth manifolds at the level of the terminal tube of the stack of fourth tubes so that the rotation of the first heat exchanger around an axis of elongation of the terminal tube is enabled.

BRIEF DESCRIPTION OF DRAWINGS

Examples of the invention will be apparent from and described in detail with reference to the accompanying drawings, in which.

DETAILED DESCRIPTION OF EMBODIMENTS

The heat exchangers are usually assembled onto the front-end of the vehicle not only as the as a standalone heat exchange units, but also as the assembly of two or more heat exchangers. Installing the assemblies comprising several heat exchangers instead of one after the other is advantageous in terms of production feasibility, cost reduction, packaging, etc.

The assembly of heat exchangers may be further referred to as the cooling assembly 1 which is considered the subject-matter of the invention. The invention concerns various types of heat exchangers, for example, radiators for high and/or low temperatures, condensers, charge air coolers, and other. The invention is described in further paragraphs in accordance to the respective figures.

Figure 1:
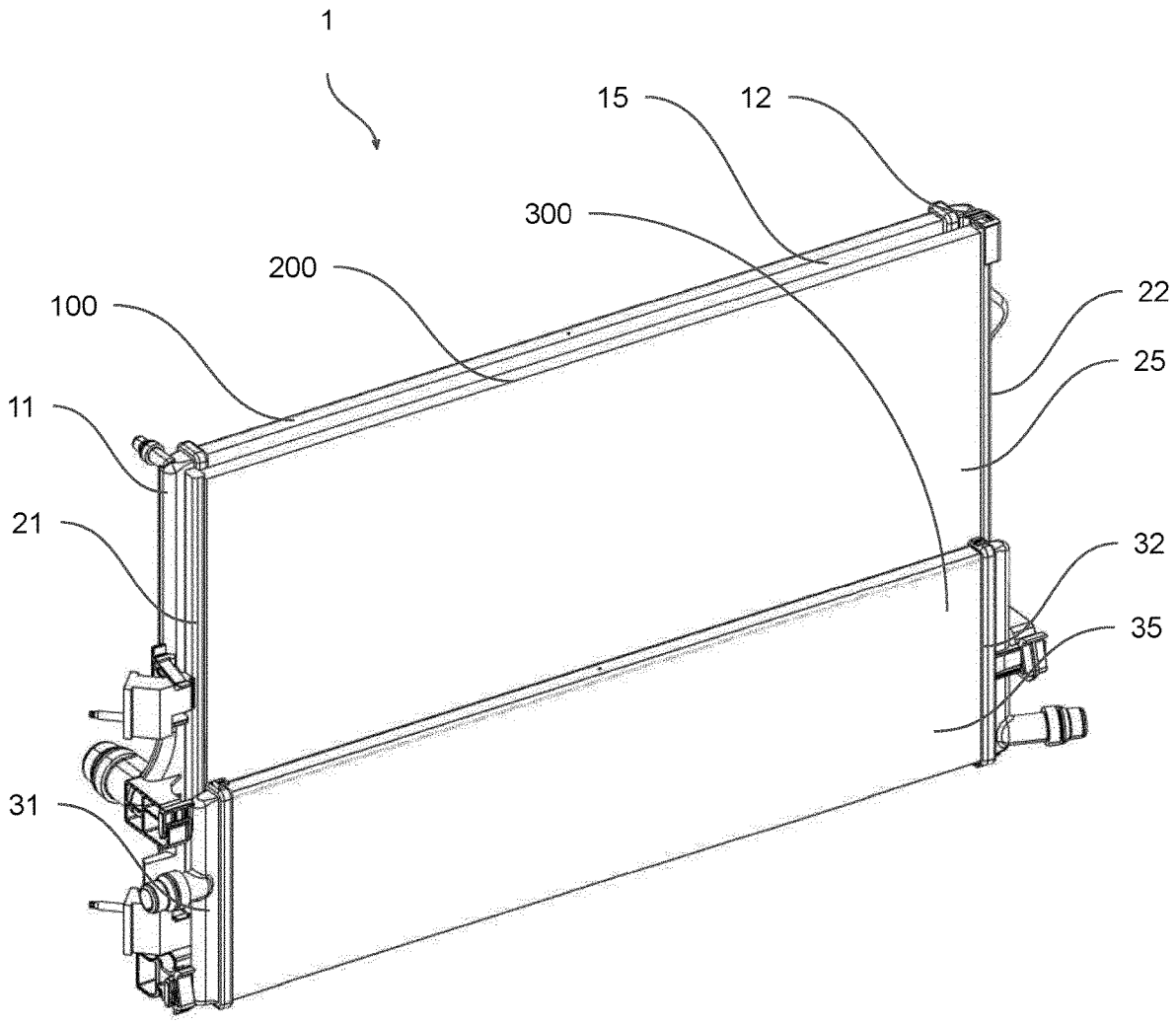
FIGS. 1 and 2 and show the perspective view of a cooling assembly wherein the heat exchangers are fixed.
Figure 2:
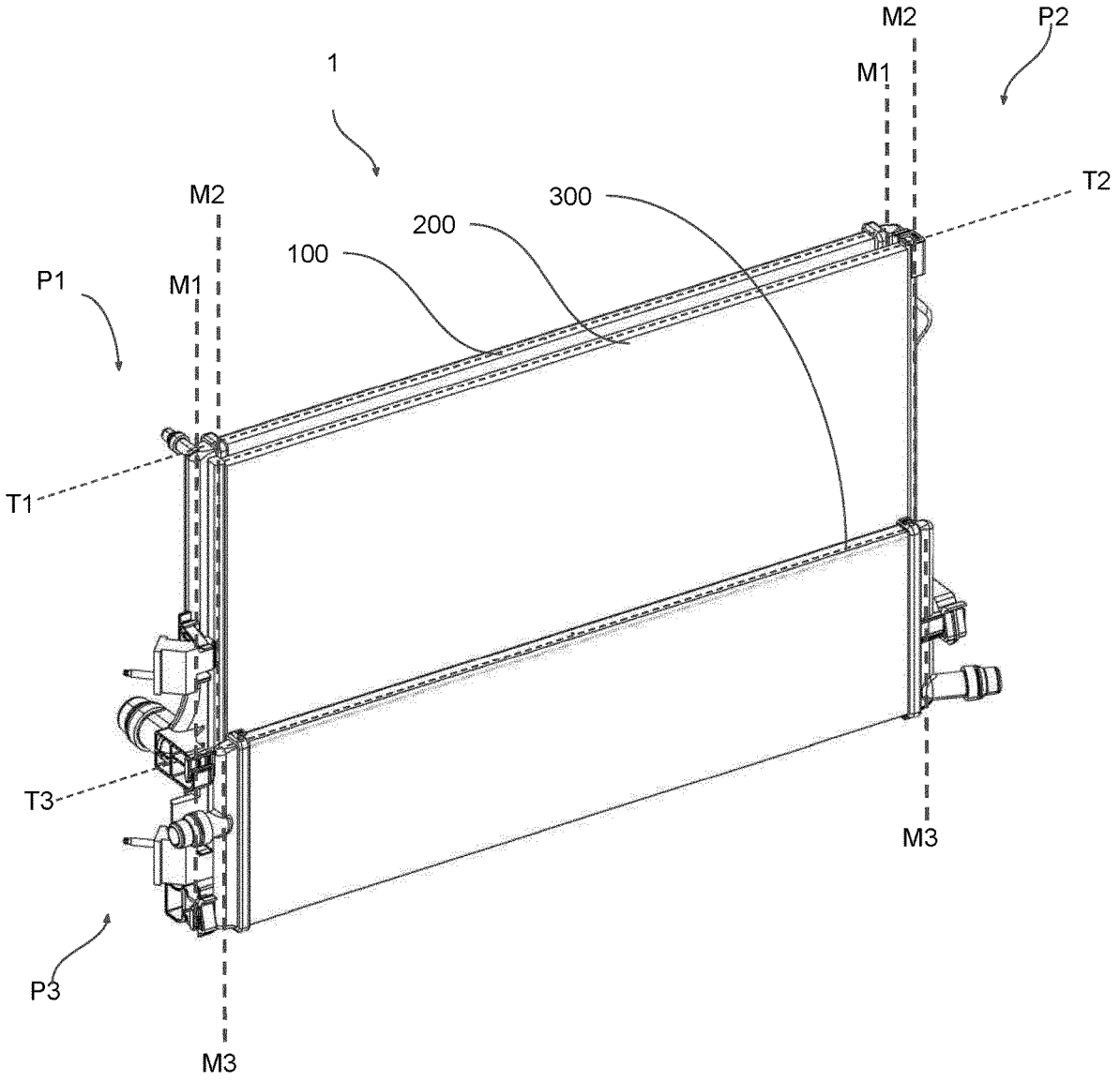

FIGS. 1 and 2 show a cooling assembly (1) configured to provide a heat exchange between the fluids. The fluids circulating in particular heat exchangers may be of different types or physical/chemical properties. The fluids circulating within the heat exchanger may be, for example: refrigerant, coolant, water, air or any other fluid is gaseous form. It is to be noted that the cooling assembly (1) does not allow mixing of the fluids circulating in different heat exchangers. Further, the term "heat exchange between the fluids" refers to the process of heat exchange between the fluid circulating within particular heat exchanger and the other fluid, e.g. raw air, which is of different temperature than the fluid within the heat exchanger.

The assembly (1) may comprise at least one first heat exchanger (100). comprising a pair of first manifolds (11, 12) comprising an axis of elongation of the first manifolds (M1). Terms such as "axis of elongation" may be defined based on design of the manifold. The manifolds are usually tubular, therefore the axis of elongation may be defined as the axis running substantially through the central portion of the channel, whereas the shape of the cross-section is irrelevant.

The first heat exchanger (100) may further comprise a plurality of first tubes (15) stacked between the first manifolds (11,12). The tubes (15) may be in fluidal communication with the manifolds (11, 12) thereby providing a fluidal communication between them. Similarly to manifolds, each first tube (15) may comprise an axis of elongation of the first tubes (T1) which is substantially perpendicular to axis of elongation of the first manifolds (M1). Depending on the shape of manifolds (11, 12) and/or tubes (15) the angle between these two sub-components may be slightly different than 90 degrees. The axis of elongation at least one first tube (15) and the axis of elongation of at least one manifold (M1) may form the general plane (P1) of the first heat exchanger (100). The general plane (P1) may thus define the orientation of the first heat exchanger (100) and it may be used as reference point.

The cooling assembly (1) may further comprise at least one second heat exchanger (200) comprising a pair of second manifolds (21, 22). Each second manifold (21, 22) may comprise an axis of elongation of the second manifolds (M2).

The second heat exchanger (200) may further comprise a plurality of second tubes (25) stacked between the second manifolds (21,22). Similarly to the first tubes (15), the second tubes (25) may be in fluidal communication with the second manifolds (21, 22) thereby providing a fluidal communication between them. Each second tube (25) may comprise an axis of elongation of the second tubes (T2) which is substantially perpendicular to axis of elongation of the second manifolds (M2) The axes of elongation of at least one second tube and at least one second manifold (T2, M2) may form the general plane (P2) of the second heat exchanger (200). Depending on the shape of manifolds (21, 22) and/or tubes (25) the angle between these two sub-components may be slightly different than 90 degrees. The general plane (P2) may thus define the orientation of the second heat exchanger (200) and it may be used as reference point.

The cooling assembly may further comprise at least one third heat exchanger (300). The second heat exchanger (300) may further comprise a pair of third manifolds (31, 32). The third manifolds (31, 32) may further comprise an axis of elongation of the third manifolds (M3). Further, the third heat exchanger (300) is adapted to be fixed to the first heat exchanger (100) along the axis perpendicular to the general planes (P1,P3) of the heat exchangers (100,300) by at least pushing the third heat exchanger (300) towards the first heat exchanger (100) so that the planes (P1, P3) remain parallel with respect to each other during and after fixing the third heat exchanger (300) to the first heat exchanger (100).

The third heat exchanger (300) may further comprise a plurality of third tubes (35) stacked between the third manifolds (31,32). Each third tube (35) may comprise an axis of elongation of the third tubes (T3) which is substantially perpendicular to axis of elongation of the third manifolds (M3). Depending on the shape of manifolds (31, 32) and/or tubes (35) the angle between these two sub-components may be slightly different than 90 degrees. The axis of elongation at least one first tube (35) and the axis of elongation of at least one manifold (M3) may form the general plane (P3) of the third heat exchanger (300). The general plane (P3) may thus define the orientation of the first heat exchanger (300) and it may be used as reference point.

In order to provide easier way of assembling two or more heat exchangers, different ways and means of fixation may be proposed.

FIGS. 3-8 show an exemplary way of fixing the second heat exchanger (200) to the first heat exchanger (100) as well as the means of fixation thereof.

Figure 3:
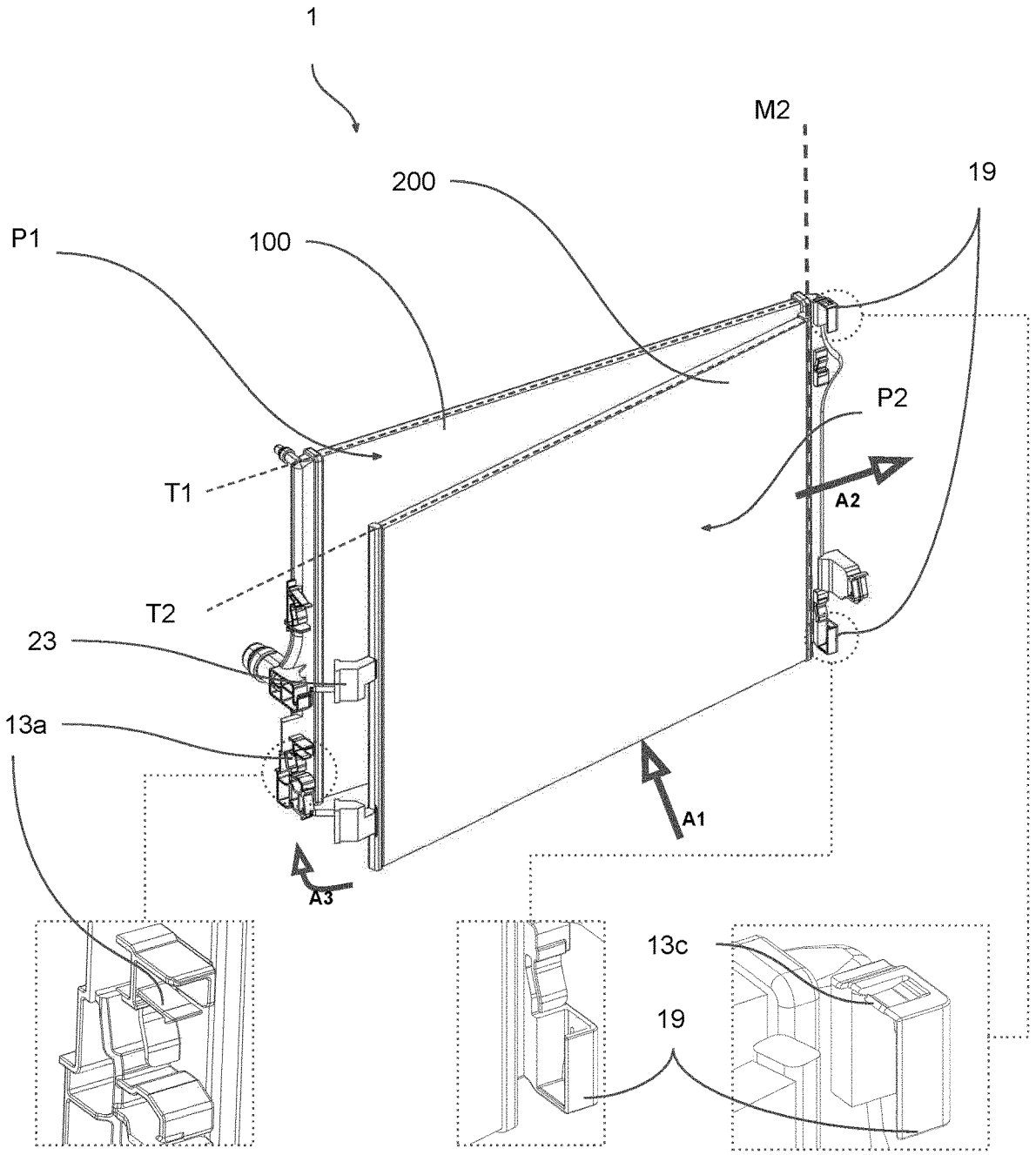
FIG. 3 shows the perspective view of the second heat exchanger and the first heat exchanger in the pre-assembly mode.
Figure 7:
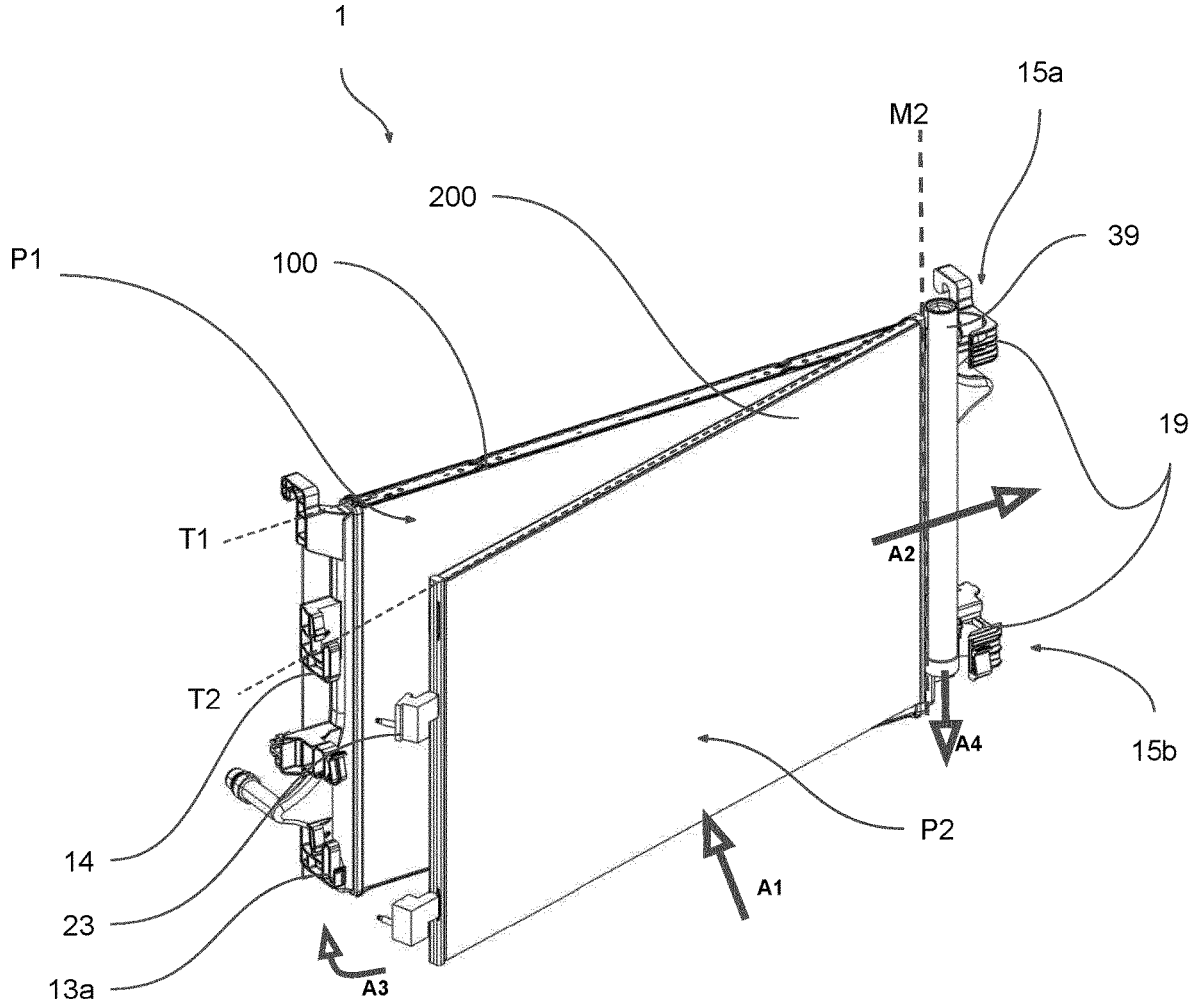
FIG. 7 shows the perspective view of the second heat exchanger and the first heat exchanger in the pre-assembly mode, wherein the second heat exchanger comprises a receiver dryer.

As shown in FIGS. 3 and 7, the second heat exchanger (200) may be adapted to be fixed to the first heat exchanger (100) at least by pivoting thereof around an axis of elongation of the second manifold (M2) until the general plane (P2) of the second heat exchanger (200) is parallel to the general plane (P1) of the first heat exchanger (100).

This assembly process may be performed either by the operator, or by a machine, depending on characteristics of the production line. The "pivoting" movement may also be regarded as "to cause to rotate", "revolve", or "turn". In particular, pivoting movement is a rotation of an object around certain axis. In this case, it is the axis of elongation of the second manifold (M2). The means which allow fixing the heat exchangers (100, 200) is this specific manner will be described in further paragraphs.

Referring to FIG. 3 the second heat exchanger (200) may be fixed to the first heat exchanger (100) as shown by the arrows A1-A3. The arrows A1, A2, A3 show directions in which the second heat exchanger (200) is moved with respect to the first heat exchanger (100) in order to fix one to the other. Initially, the second heat exchanger (200) may be arranged with respect to the first heat exchanger (100) so that the general plane (P2) of the second heat exchanger (200) is inclined the general plane (P1) of the first heat exchanger (100). Next, the second heat exchanger (200) may be moved towards the first heat exchanger (100) along the axis perpendicular with respect to the general plane (P1) of the first heat exchanger (100), wherein such axis is depicted in FIG. 3 by arrow A1. Next, the second manifold (22) may be moved towards the first manifold (12) as depicted in FIG. 3 by arrow A2. When the second manifold (22) is in contact with the first manifold (12), the second heat exchanger (200) may be pivoted in order to fix the second manifold (21) to the first manifold (11) as depicted by arrow A3 in FIG. 3. The second heat exchanger may be pivoted until the general plane (P2) of the second heat exchanger (200) is parallel to the general plane (P1) and the second manifold (21) is fixed to the first manifold (11). The same process may refer to fixation process shown in FIG. 7.

Figure 4:
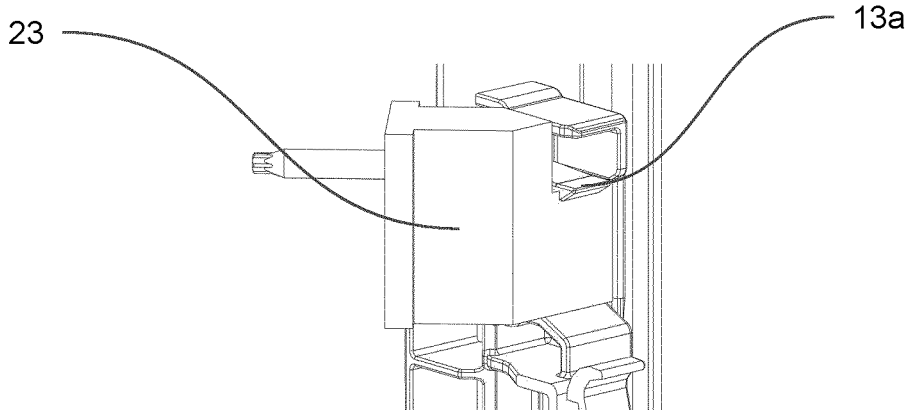
FIG. 4 shows the detailed view of the connection between the first clip and the second block in the post-assembly mode of first and second heat exchangers.

As further shown in FIG. 4, at least one of the first manifolds (11, 12) may comprise at least one first clip (13*a*)

configured to immobilize the second heat exchanger (200) at least in a direction transverse to axis of elongation of the first manifolds (M1). In FIGS. 1-3 and 7, the first clips (13*a*) are located on at least one first manifold (11). The first clips (13*a*) may be made of the same material as the manifolds (11, 12). In particular, the first clips (13*a*) and the manifold (11, 12) may be made in one piece. The first clips (13*a*) are elastic enough to allow quick and easy fixation of the two heat exchangers (100, 200). Preferably, the first clips (13*a*) may be in form of protruding elements with substantially triangular portions configured to attach to the second manifold (21), however, other shapes of the first clips (13*a*) are also envisaged. During the process of assembling the heat exchangers (100, 200), the shape and flexibility of the first clips (13*a*) allows the second manifolds (21, 22) to overcome the tension caused by the clips (13*a*). When assembled, the first clips (13*a*) immobilize the second heat exchanger (200) in at least axis perpendicular to the axis of elongation of the second manifolds (21, 22).

FIG. 4 shows that the second manifold (21, 22) may comprise at least one second connection block (23) fluidly connected therewith, wherein the second connection block (23) is configured to engage with at least one of the first clips (13*a*). The second connection block (23) may be arranged on the second manifold (21) which is opposite to the second manifold (22) which forms the pivoting axis which is considered as the axis of elongation (M2) of this manifold (22).

Figure 5:
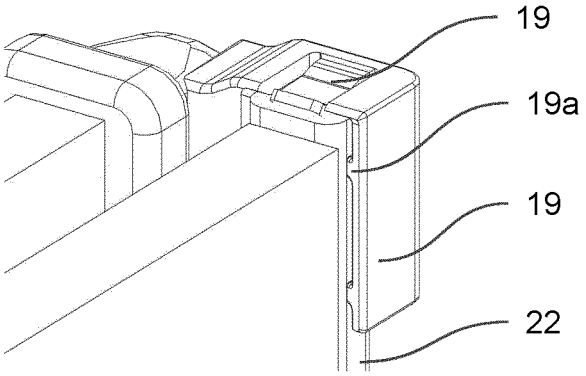
FIGS. 5 and 6 show the detailed views of the connection between the U-shaped portion and the second manifold in the post-assembly mode of first and second heat exchangers.
Figure 6:
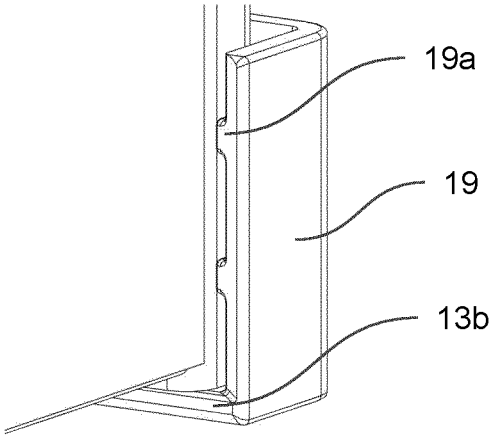

As shown in FIGS. 5 and 6, in order to facilitate the assembling process, at least one of the first manifolds (12) may comprise at least one essentially U-shaped portion (19) configured to receive one of the second manifolds (22). The U-shaped portion (19) enables receiving and rotation of one of the second manifolds (21, 22) around its axis of elongation (M2) while in contact therewith. The second manifold (22) which is received in U-shaped portion (19) is immobilized when the general plane (P2) of the second heat exchanger (200) is parallel to the general plane (P1).

As shown in FIG. 7, the second heat exchanger (200) may comprise a bottle (39) fluidly connected to at least one second manifold (21, 22). The bottle (39) may serve as, for example, a receiver-dryer for condenser. The bottle (39) may be coplanar with the general plane (P2) of the second heat exchanger (200). The U-shaped portion (19) of the first heat exchanger (100) may be configured to receive the bottle (39) so that it enables rotation of the bottle (39) around its axis of elongation (M2) while in contact therewith.

Alternatively, the second heat exchanger (200) may be fixed to the first heat exchanger (100) not only by the action of pivoting around the axis of elongation (M2) of the second manifold (22), but also by shifting the rotated second heat exchanger (200) parallelly to the axis of elongation of the second manifolds (21, 22), as shown by an arrow A4 in FIG. 7. The means of fixing the second heat exchanger (200) to the first heat exchanger (100) during the shifting movement are described in further paragraphs. It is to be noted that similarly to the second manifolds (21, 22), the bottle (39) may also comprise its axis of elongation. Therefore, the second heat exchanger (200) may be fixed to the first heat exchanger (100) by the action of pivoting the bottle (39) around its axis of elongation, and by shifting the rotated second heat exchanger (200) parallelly to the axis of elongation of the second manifolds (21, 22), as shown by an arrow A4 in FIG. 7.

The second heat exchanger (200) may be secured to the first heat exchanger (100) by shifting one in opposite direction with respect to the other along their parallel general planes (P1, P2).

Figure 8:
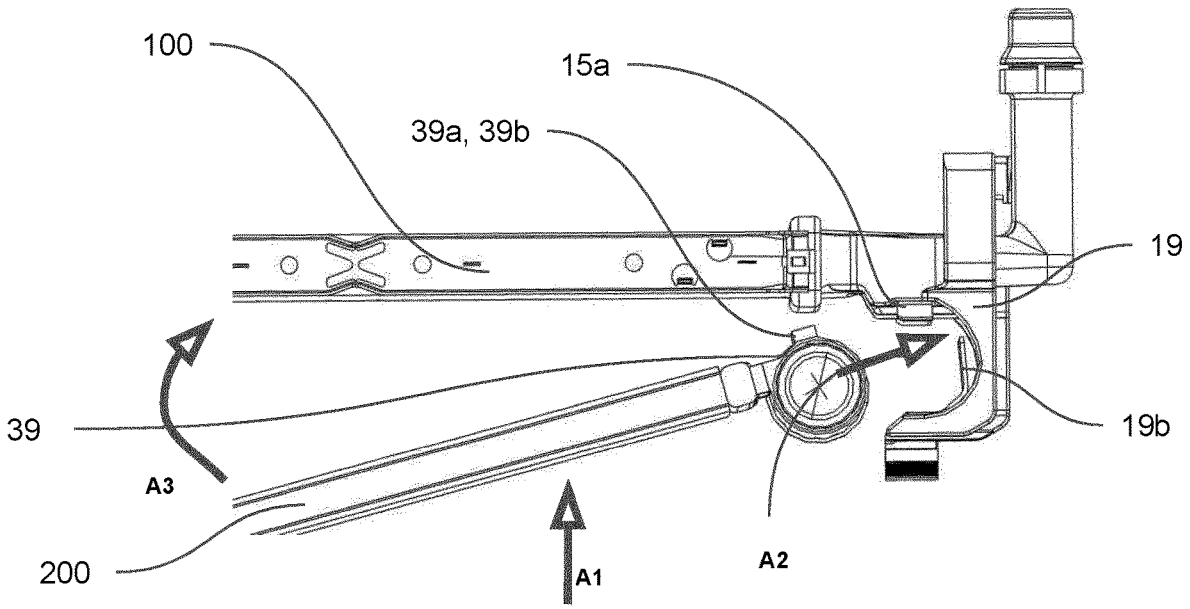
FIG. 8 shows the top view of the pre-assembly mode of the heat exchangers from FIG. 7.

As further shown in FIGS. 7 and 8, the first manifold (11, 12) may comprise a first bottle clip (15*a*), and a first bottle support (15*b*) and the bottle (39) comprising a first bottle protrusion (39*a*) and a second bottle protrusion (39*b*), wherein the first bottle support (15*b*) is configured to support the second bottle protrusion (39*b*) and the first bottle clip (15*a*) is configured to be engaged with the first bottle protrusion (39*a*), so that the second heat exchanger (200) is secured to the first heat exchanger (100). The first bottle support (15*b*) and the second bottle protrusion (39*b*) are not depicted in FIG. 8 since they are obscured by the first bottle support (15*a*) and the first bottle protrusion (39*a*), respectively. The U-shaped portion (19) may further comprise at least one primary bottle tensioner (19*b*) configured to mitigate a gap between the bottle (39) and the U-shaped portion (19). This allows to reduce the play and between the heat exchangers (100, 200) and vibrations within the cooling assembly (1).

Further, at least one of the first manifolds (11, 12) may comprise at least one L-shaped support (14) protruding from the at least one first manifold (11, 12) a shown in FIG. 7. The free end of the L-shaped portion (14) may be pointing a direction parallel with respect to the main axis of elongation the first manifold (M1, M2), and the first clip (13*a*) pointing a direction substantially opposite to the direction of the free end of the L-shaped portion (14). It is to be noted that the L-shaped portion (14) preferably receives, for example, the second block (23) of the second heat exchanger (200) in substantially downward direction. Term "downward" direction may be considered as the same direction in which the gravitational force impacts the objects. Alternatively, the embodiments in which the L-shaped portion (14) receives, for example, the second block (23) of the second heat exchanger (200) in substantially upward direction is also envisaged, wherein the upward direction is opposite to downward direction.

The features described in above-mentioned paragraphs allow the second heat exchanger (200) to be fixed to the first heat exchanger (100) by pivoting thereof around an axis of elongation of the second manifold (M2) until the general plane (P2) of the second heat exchanger (200) is parallel to the general plane (P1) of the first heat exchanger (100), and by moving the second heat exchanger (200) along its general plane (P2) towards the L-shaped support (14) an the first clip (13*a*) until the second heat exchanger (200) is immobilized.

Figure 9:
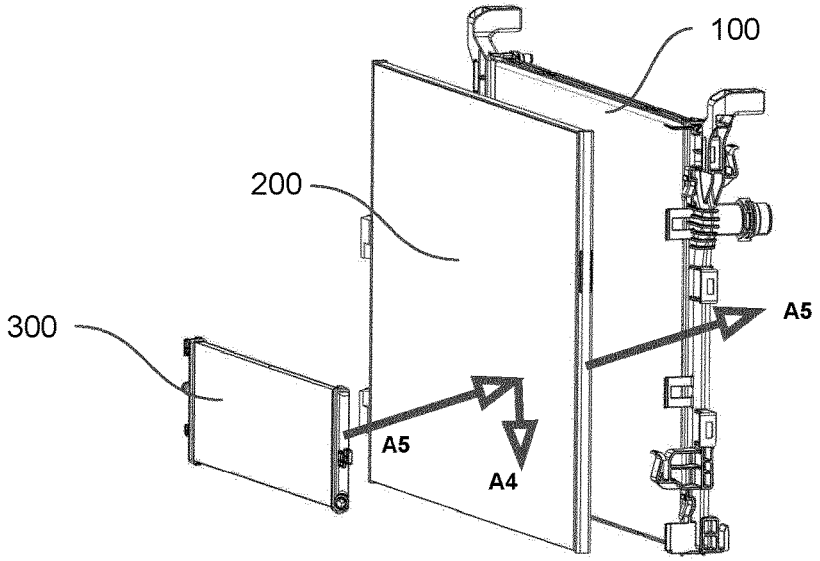
FIG. 9 shows the perspective view of the third heat exchanger, the second heat exchanger and the first heat exchanger in the pre-assembly mode, according to embodiment of the invention.
Figure 10:
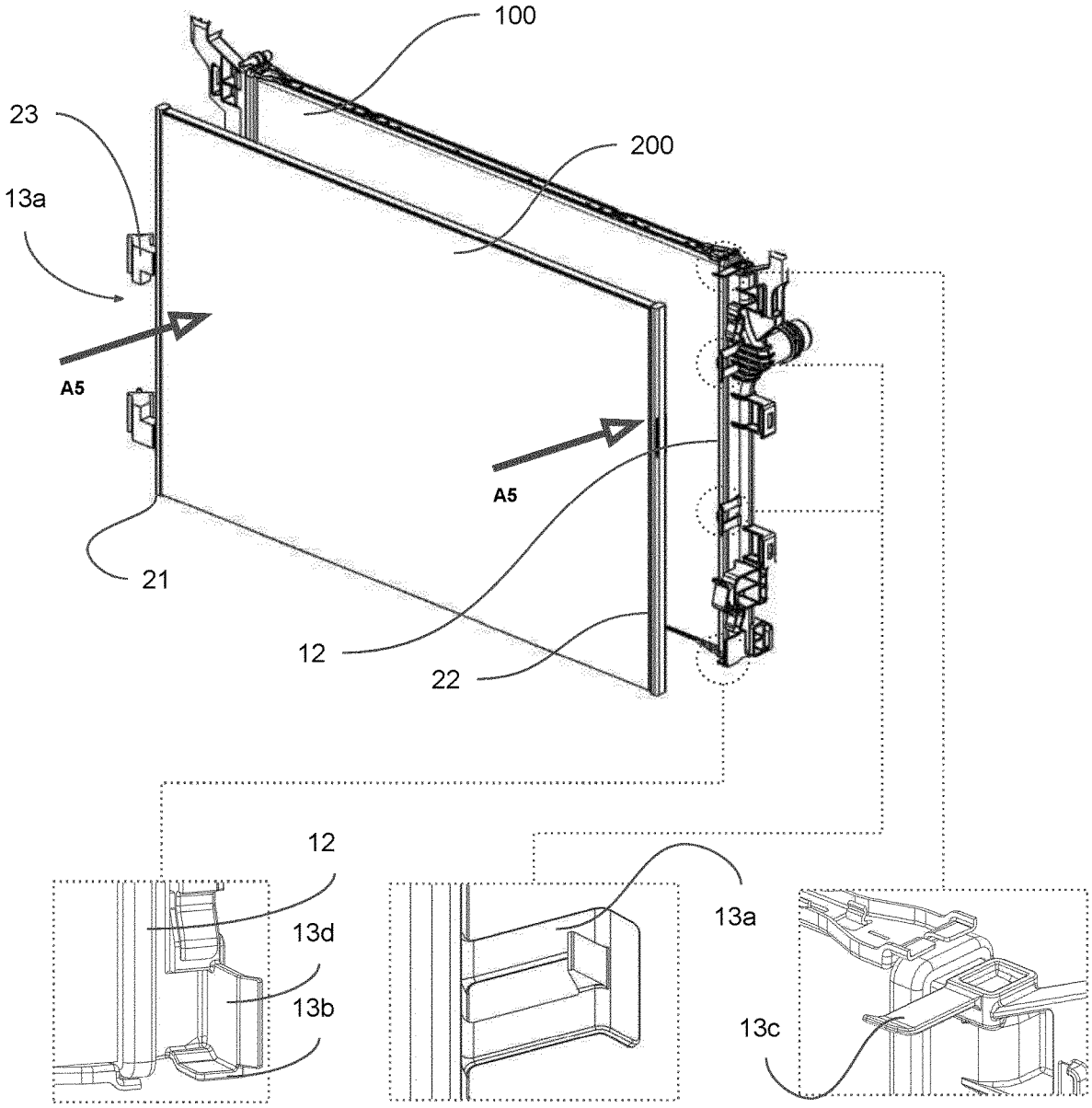
FIG. 10 shows the perspective view of the second heat exchanger and the first heat exchanger in the pre-assembly mode, according to alternative means of assembling.
Figure 11:
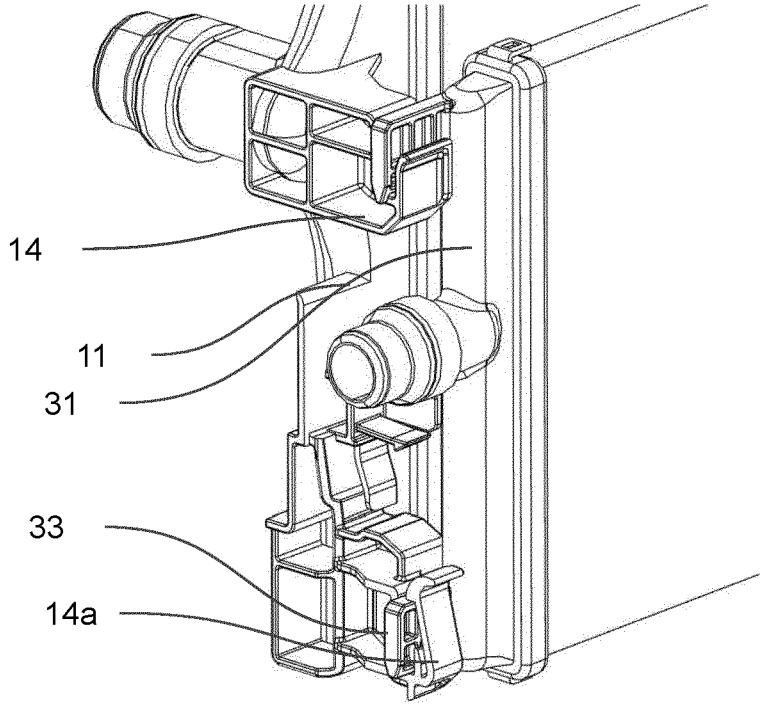
FIG. 11 shows the detailed view of the connection between the third heat exchanger and the first heat exchanger in the post-assembly mode.

FIGS. 9 and 10 show an alternative embodiment, wherein the second heat exchanger (200) may be fixed to the first heat exchanger (100) by at least pushing the second heat exchanger (200) towards the first heat exchanger (200) so that their planes (P1, P2) remain parallel with respect to each other during and after fixing one heat exchanger (200) to the other (100). As shown in FIG. 9, The second heat exchanger (200) is fixed to the first heat exchanger (100) along the direction pointed by an arrow A5, whereas the third heat exchanger (300) is fixed to the first heat exchanger first by moving it along the direction pointed by the arrow A5 and next by moving it along the direction pointed by the arrow A4.

FIG. 10 shows the pre-assembly mode of the heat exchangers (100, 200), wherein the arrows A5 show the direction in which the second heat exchanger (200) is moved towards the first heat exchanger (100).

The second heat exchanger (200) may be fixed to the heat exchanger (100) by the means of the first clips (13*a*) only. However, the clips may vary depending on which portion of the second heat exchanger (200) is supposed to be immobilized with respect to the first heat exchanger (100). Since the second heat exchanger (200) comprises two connection blocks (23), the first manifold (11) comprises two pairs of the first clips (13*a*), each pair of first clips (13*a*) being configured to attach to one connection block (23). The pair of the first clips (13*a*) may protrude in the same direction, perpendicularly with respect to the general plane (P1) of the first heat exchanger (100). In order to effectively attach to respective connection block (23), each clip of the pair of clips may comprise a triangular portion configured to immobilize the connection block (23) in a direction perpendicular with respect to the general plane (P2) of the second heat exchanger (200). The triangular portions of the respective first clips (13*a*) of the pair of clips may be oriented in the opposite directions, so that the attaching portions are facing the connection block (23).

As further shown in FIG. 10, the other manifold (12) of the first heat exchanger (100) may comprise a support (13*b*) configured to provide a parallel alignment of the axis of elongation of the second tubes (T2) with respect to axis of elongation of the first tubes (T1). The support (13*b*) comprises a flat surface perpendicular with respect to the general plane (P1) of the first heat exchanger (100) so that it may support the terminal portion of the second manifold (22).

At least one first manifold (11, 12) may further comprise at least one tensioner (13*c*) configured to engage with at least one of the second manifolds (21, 22), so that the second manifold (22) is pushed towards the support (13*b*) in parallel direction with respect to axis of elongation of the second manifold (M2). The tensioner (13*c*) is substantially a flat, elastic portion which is in contact with the opposite terminal end of the second manifold (21) as the support (13*b*). The tensioner (13*c*) provides a tight connection and proper orientation of the heat exchangers (100, 200) however, it enables easy assembly of these two sub-components.

In order to further facilitate the assembly of the heat exchangers (100, 200), the support (13*b*) may further comprise a guiding portion (13*d*) which is inclined with respect to the axis perpendicular to the axis of elongation of the second manifolds (M2), so that the second manifold (21) may slide on its surface in order to be directed onto the support (13*b*).

The features such as support (13*b*) and/or the tensioner (13*c*) may be easily applied where applicable in order to further improve the cooling assembly (1).

For instance, the support (13*b*) may protrude from the U-shaped portion (19) so that it enables rotation the manifold (21, 22) around its axis of elongation (M2) while in contact therewith.

Similarly, the tensioner (13*c*) may protrude from the U-shaped portion (19) so that the free end of the tensioner (13*c*) is oriented in the same direction as at least one free end of the U-shaped portion (19), as shown in FIG. 3.

These features allow to enhance the firm connection between the first heat exchanger (100) and the second heat exchanger (200), particularly in the axis of elongation of the second manifolds (21, 22).

The U-shaped portion (19) may further comprise at least one rib (19*a*) located between the inner face of the U-shaped portion (19) and the second manifold (21, 22), wherein the rib (19*a*) is configured to secure the second heat exchanger (200) in a perpendicular direction with respect to the general plane (P2) thereof, after pivoting the second heat exchanger (200) around an axis of elongation of the second manifold (M2). The rib (19*a*) may be in a form of at least one curb on the inner face of the U-shaped portion (19), extending parallelly with respect to the axis of elongation of the first tubes (T1).

As shown in FIGS. 1,2, 9 and 11, the cooling assembly (1) may comprise a third heat exchanger (300). The third heat exchanger (300) may comprise third manifolds (31, 32) comprising at least one flat protrusion (33) extending outwardly and substantially in parallel with respect to the general plane (P3) of the third heat exchanger (300).

In order to attach the third heat exchanger (300), each first manifold (11, 12) may comprise at least one L-shaped support (14) protruding therefrom, wherein the free end of the L-shaped support (14) is pointing in a direction parallel with respect to the main axis of the first manifolds (M1). The flat protrusions (33) engage with respective L-shaped supports (14) so that the third heat exchanger (300) is fixed to the first heat exchanger (100).

The L-shaped support (14) may also protrude directly from the U-shaped portion (19) of the first manifold (11,12) as shown in FIG. 7.

The L-shaped support (14) may comprise at least one third clip (14*a*) configured to engage with respective flat protrusion (33) of the third heat exchanger (300). It is to be noted that the L-shaped portion (14) preferably receives, for example, the flat protrusion (33) of the third heat exchanger (300) in substantially downward direction. Alternatively, the embodiments in which the L-shaped portion (14) receives, for example, the flat protrusion (33) of the third heat exchanger (300) in substantially upward direction is also envisaged, wherein the upward direction is opposite to downward direction.

Figure 12:
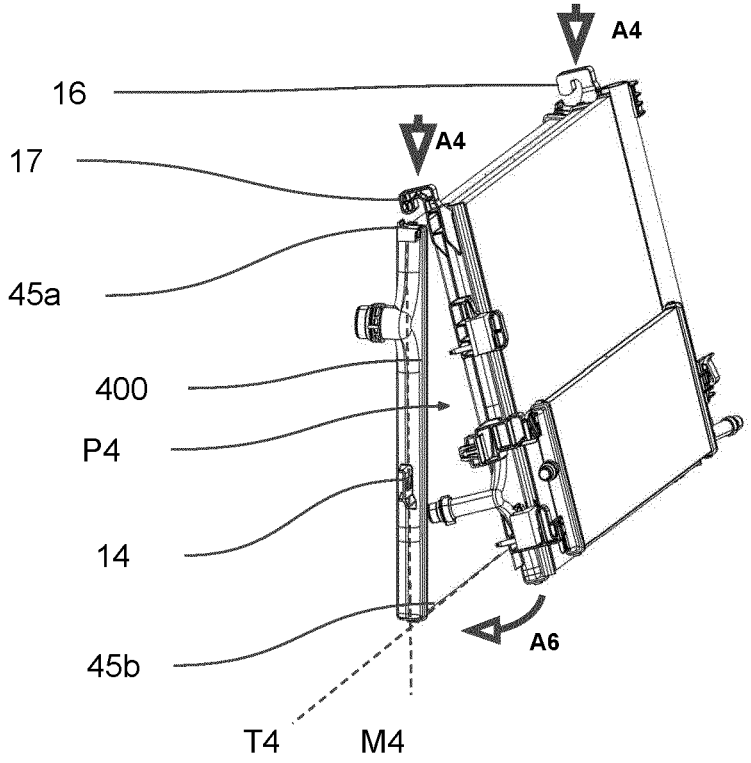
FIG. 12. shows the perspective view of the fourth heat exchanger and the pack of first, second and third heat exchangers, wherein the pack of heat exchangers is in the pre-assembly mode with respect to the fourth heat exchanger.

As shown in FIG. 12, the cooling may also comprise a fourth heat exchanger (400) comprising a pair of fourth manifolds (41, 42). The fourth manifolds (41, 42) may comprise an axis of elongation of the fourth manifolds (M4), and a plurality of fourth tubes (45) stacked between the fourth manifolds (41, 42). The stack of fourth tubes (45) may comprise two terminal tubes (45*a*, 45*b*) located on opposite sides of the stack. Each fourth tube (45) comprises an axis of elongation of the fourth tubes (T4) which is substantially perpendicular to axis of elongation of the fourth manifolds (M4), wherein the axes (T4, M4) form the general plane (P4) of the fourth heat exchanger (400).

Further, the fourth heat exchanger (400) is adapted to be fixed at least to the first heat exchanger (100) at least by pivoting thereof around an axis of elongation of the terminal tube (45*a*) until the general plane (P4) of the fourth heat exchanger (400) is parallel to the general plane (P1) of the first heat exchanger (100).

In order to facilitate the pivot movement of the fourth heat exchanger (400), the first manifolds (11, 22) may comprise a pair of C-shaped hooks (16, 17) adapted to provide a hinge-like connection with the fourth manifolds (41, 42) at the level of the terminal tube (45*a*) of the stack of fourth tubes (45) so that the rotation of the first heat exchanger (100) around an axis of elongation of the terminal tube (45*a*) is enabled.

The fourth manifolds (41, 42) may also comprise slots for receiving said C-shaped hooks (16, 17). As further shown in FIG. 12, the second and the third heat exchangers (200, 300) are already fixed to the first heat exchanger (100). The heat exchanger (100) may initially be inclined with respect to the fourth heat exchanger (400) to enable attaching the C-shaped portions (16, 17). First, the inclined first heat exchanger (100) is moved in a direction parallel to the axis of elongation of the fourth manifolds (M4), wherein arrows A4 show the direction in which the first heat exchanger (100) is moved towards the fourth heat exchanger (400). Next, when the C-shaped hooks (16, 17) are engaged with the fourth heat exchanger (400), the first heat exchanger (100) may be rotated around the axis of elongation of the terminal tube (45*a*). The pivot movement is continued until the general plane (P4) of the fourth heat exchanger (400) is parallel to the general plane (P1) of the first heat exchanger (100). The rotation around the axis of elongation of the terminal tube (45*a*) is depicted in FIG. 12 by arrow A6.

In order to secure the assembly, the first and the fourth heat exchanger (100, 400) may be fixed to each other by at least one clip.

The embodiments presented above allow to provide new cooling assemblies (1) not only by features explicitly disclosed in the description, but also by any combination thereof.

Other variations to the disclosed embodiments can be understood and effected by those skilled in the art in practicing the claimed invention, from a study of drawings, the disclosure, and the appended claims. The mere fact that certain measures are recited in mutually different dependent claims does not indicate that a combination of these measures cannot be used to the advantage.

The invention claimed is:

1. A cooling assembly configured to provide a heat exchange between fluids comprising:

at least one first heat exchanger comprising a pair of first manifolds comprising an axis of elongation of the first manifolds, and a plurality of first tubes stacked between the first manifolds, each first tube comprising an axis of elongation of the first tubes which is substantially perpendicular to axis of elongation of the first manifolds, wherein the axes form the general plane of the first heat exchanger;

at least one second heat exchanger comprising a pair of second manifolds comprising an axis of elongation of the second manifolds, and a plurality of second tubes stacked between the second manifolds, each second tube comprising an axis of elongation of the second tubes which is substantially perpendicular to axis of elongation of the second manifolds, wherein the axes form the general plane of the second heat exchanger;

at least one third heat exchanger comprising a pair of third manifolds comprising an axis of elongation of the third manifolds, and a plurality of third tubes stacked between the third manifolds, each third tube comprising an axis of elongation of the third tubes which is substantially perpendicular to axis of elongation of the third manifolds, wherein the axes form the general plane of the third heat exchanger, wherein the second heat exchanger is adapted to be fixed to the first heat exchanger at least by pivoting thereof around an axis of elongation of the second manifold until the general plane of the second heat exchanger is parallel to the general plane of the first heat exchanger, wherein the third heat exchanger is adapted to be fixed to the first heat exchanger along the axis perpendicular to the general planes of the heat exchangers by at least pushing the third heat exchanger towards the first heat exchanger so that the planes remain parallel with respect to each other during and after fixing one heat exchanger to the other, wherein each first manifold of the pair of first manifolds comprises a U-shaped portion and an L-shaped support, wherein the U-shaped portion is configured to receive at least one second manifold of the pair of second manifolds, and where the L-shaped support protrudes directly from the U-shaped portion and is configured to receive a flat protrusion of the third heat exchanger in a downward direction.

2. The cooling assembly, according to claim 1, wherein the U-shaped portion is further configured to facilitate rotation of the at least one second manifold around the axis of elongation of the second manifolds while in contact therewith.

3. The cooling assembly, according to claim 1, wherein at least one of the first manifolds comprises at least one first clip configured to immobilize the second heat exchanger at least in a direction transverse to the axis of elongation of the first manifolds.

4. The cooling assembly according to claim 3, wherein the second manifold comprises at least one second connection block fluidly connected therewith, wherein the second connection block is configured to engage with at least one of the first clips.

5. The cooling assembly according to claim 1, wherein at least one of the first manifolds comprises a support configured to provide a parallel alignment of the axis of elongation of the second tubes with respect to the axis of elongation of the first tubes.

6. The cooling assembly according to claim 5, wherein at least one of the first manifolds comprises at least one tensioner configured to engage with at least one of the second manifolds so that the manifold is pushed towards the support in parallel direction with respect to axis of elongation of the second manifold.

7. The cooling assembly according to claim 5, wherein the support protrudes from the U-shaped portion so that it enables rotation of the at least one second manifold around the axis of elongation of the second manifolds while in contact therewith.

8. The cooling assembly according to claim 1, wherein the second heat exchanger comprises a bottle fluidly connected to at least one of the second manifolds, the bottle being coplanar with the general plane of the second heat exchanger, wherein the U-shaped portion is configured to receive the bottle so that it enables rotation of the bottle around the axis of elongation of the second manifolds while in contact therewith.

9. The cooling assembly according to claim 8, wherein the second heat exchanger is secured to the first heat exchanger by pushing the second heat exchanger towards the first heat exchanger so that the general plane of the second heat exchanger remains parallel to the general plane of the first general heat exchanger during and after securing the second heat exchanger to the first heat exchanger.

10. The cooling assembly according to claim 8, wherein the first manifold comprises a first bottle clip, and a first bottle support, the bottle comprises a first bottle protrusion and a second bottle protrusion, wherein the first bottle support is configured to support the second bottle protrusion and the first bottle clip is configured to be engaged with the first bottle protrusion so that the second heat exchanger is secured to the first heat exchanger.

11. The cooling assembly according to claim 8, wherein the U-shaped portion comprises at least one primary bottle tensioner configured to mitigate a gap between the bottle and the U-shaped portion.

12. The cooling assembly according to claim 8, wherein at least one of the first manifolds comprises a plurality of first clips, wherein a free end of the L-shaped portion is arranged pointing a direction parallel to the axis of elongation of the first manifold, and the first clips are arranged pointing in a direction substantially opposite to the direction of the free end of the L-shaped portion.

13. The cooling assembly according to claim 1 comprising a fourth heat exchanger comprising a pair of fourth manifolds comprising an axis of elongation of the fourth manifolds, and a plurality of fourth tubes stacked between the fourth manifolds, the stack of fourth tubes comprising two terminal tubes located on opposite sides of the stack, each fourth tube comprising an axis of elongation of the fourth tubes which is substantially perpendicular to axis of elongation of the fourth manifolds, wherein the axes form the general plane of the fourth heat exchanger and wherein the fourth heat exchanger is adapted to be fixed at least to the first heat exchanger at least by pivoting thereof around an axis of elongation of the terminal tube until the general plane of the fourth heat exchanger is parallel to the general plane of the first heat exchanger.

14. The cooling assembly according to claim 13, wherein the first manifolds comprise a pair of C-shaped hooks adapted to provide a hinge-like connection with the fourth manifolds at a level of one of the two terminal tubes of the stack of fourth tubes so that a rotation of the first heat exchanger around the axis of elongation of the terminal tube is enabled.

15. A motor vehicle comprising at least one cooling assembly according to claim 1.

* * * * *